US005654117A

United States Patent [19]

Nealey et al.

[11] Patent Number: 5,654,117

[45] Date of Patent: Aug. 5, 1997

[54] PROCESS FOR PREPARING AN ELECTROPHOTOGRAPHIC IMAGING MEMBER

[75] Inventors: Richard H. Nealey, Penfield; John M. Hammond, Ontario; James M. Markovics, Rochester; Walter H. Lerminiaux; Martha J. Stegbauer, both of Ontario, all of N.Y.

[73] Assignee: Xerox Corporation, Stamford, Conn.

[21] Appl. No.: 414,163

[22] Filed: Mar. 31, 1995

Related U.S. Application Data

[63] Continuation-in-part of Ser. No. 932,150, Aug. 19, 1992, Pat. No. 5,476,740.

[51] Int. Cl.[6] ..... G03G 5/04

[52] U.S. Cl. ..... 430/56; 430/132

[58] Field of Search ..... 430/127, 130, 430/132, 56

[56] References Cited

U.S. PATENT DOCUMENTS

| | | | |
|---|---|---|---|
| 4,018,602 | 4/1977 | Chu | 252/501 |
| 4,082,551 | 4/1978 | Steklenski et al. | 96/1 PC |
| 4,521,457 | 6/1985 | Russell et al. | 427/286 |
| 4,571,371 | 2/1986 | Yashiki | 430/62 |
| 4,579,801 | 4/1986 | Yashiki | 430/60 |
| 4,855,203 | 8/1989 | Badesha et al. | 430/59 |
| 5,037,676 | 8/1991 | Petropoulos et al. | 427/294 |
| 5,079,854 | 1/1992 | Hammond et al. | 31/187 |
| 5,120,627 | 6/1992 | Nozomi et al. | 430/132 |
| 5,149,612 | 9/1992 | Langlois et al. | 430/132 |
| 5,219,690 | 6/1993 | Hammond | 430/58 |
| 5,248,529 | 9/1993 | Hammond et al. | 427/558 |
| 5,324,615 | 6/1994 | Stegbauer et al. | 430/132 |
| 5,385,796 | 1/1995 | Spiewak et al. | 430/131 |
| 5,449,582 | 9/1995 | Hsieh et al. | 430/135 |

*Primary Examiner*—John Goodrow

*Attorney, Agent, or Firm*—Oliff & Berridge

[57] ABSTRACT

An electrophotographic imaging member is prepared by applying a charge generating layer to an underlying layer and drying the charge generating layer at ambient temperature.

6 Claims, No Drawings

PROCESS FOR PREPARING AN ELECTROPHOTOGRAPHIC IMAGING MEMBER

This application is a continuation-in-part of U.S. application Ser. No. 07/932,150, filed Aug. 19, 1992, now U.S. Pat. No. 5,476,740.

BACKGROUND OF THE INVENTION

This invention relates in general to electrophotography and in particular to a process for preparing an electrophotographic imaging member.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as a paper. This imaging process may be repeated many times with reusable photoconductive insulating layers.

During machine function, a photoconductive imaging member is constantly under repetitive electrophotographic cycling which subjects the electrically operative layers to high electrical charging/discharging cycles, multiple exposures to light for latent imaging development and erasure, and heat due to temperature elevation as a result of machine operation. The repetitive electrical and light fatigue lead to a gradual deterioration in the electrical characteristics of the imaging member, and limit its service life in the field. In the attempt to fabricate a robust photoconductive imaging system, many innovative ideas have been attempted with the intent to overcome this shortfall and extend the electrical functional life of the imaging member.

Modern composite imaging members have been developed having numerous layers, which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, and a charge transport layer. This photoreceptor may also comprise additional layers such as an anti-curl layer and an optional overcoating layer.

Various coating methods are used for applying layers in a multi-layer electrophotographic imaging member. The methods include dip coating, roll coating, Meyer bar coating, bead coating, curtain flow coating, vacuum deposition and solution coating. U.S. Pat. No. 4,082,551 to Steklenski et al. discloses a process of coating multiple layers onto an insulating, polyester substrate by applying solutions having the coating substance dissolved therein and drying each applied layer before coating a subsequent layer.

U.S. Pat. No. 4,571,371 to Yashiki discloses an electrophotographic photosensitive member having a charge generating layer and a charge transport layer. A dispersion of charge generating material dissolved in solvent is applied to a cured polyamide resin layer by soaking and drying at 100° C. for 10 minutes to form a charge generating layer.

Subsequently, a solution containing a charge transfer material is applied to the dried charge generating layer followed by drying at 100° C. for 60 minutes to form a charge transfer layer.

U.S. Pat. No. 4,579,801 to Yashiki discloses a process for applying a dispersion of charge generating material in a solution containing a binder resin to a suitable substrate or dried underlayer. The charge generation layer can be formed by vapor deposition.

U.S. Pat. No. 4,521,457 to Russell et al. discloses a process for simultaneously constraining two different coating materials and forming on a substrate a continuous, unitary layer comprising adjacent "ribbons," each ribbon comprised of different materials and in edge-to-edge contact with an adjacent ribbon. The coated ribbons are dried in two zones, one at about 57° C. and another at about 135° C. The process is suitable for producing electrophotographic imaging members utilizing multi-active layers.

U.S. Pat. 4,855,203 to Badesha et al. discloses a solution process for the preparation of photogenerating compositions for use in photoconductive imaging members. A photoconductive layer is prepared by a process that comprises dissolving an inorganic photoconductive component in a solvent, removing suspended particles, depositing the resulting solution on a supporting substrate followed by heating.

The present invention relates to a process for preparing an electrophotographic imaging member. The process results in a photoreceptor that surprisingly exhibits lower dark decay and greater infra-red photosensitivity.

SUMMARY OF THE INVENTION

The present invention is directed to a process for preparing an electrophotographic imaging member having a charge generating layer. The process comprises applying a charge generating layer to an underlying layer and drying the charge generating layer at ambient temperature.

DESCRIPTION OF PREFERRED EMBODIMENTS

The process of the present invention provides a photoreceptor that exhibits lower dark decay and greater infra-red photosensitivity. In one embodiment of the present invention, the process prepares an electrophotographic imaging member having at least a charge generating layer and a charge transport layer. The electrophotographic imaging member may be a composite imaging member that includes a supporting substrate, a conductive layer, a blocking layer, a charge generating layer and a charge transport layer. Other combinations of layers suitable for use in the electrophotographic imaging member are also within the scope of the invention. For example, an anti-curl backing layer and/or a protective overcoat layer may be included and the substrate and conductive layer may be combined. Additionally, a ground strip may be provided adjacent the charge transport layer and an outer edge of the imaging member. The ground strip may be coated adjacent to the charge transport layer so as to provide grounding contact with a grounding device.

The substrate, conductive layer, blocking layer and adhesive layers, if incorporated into the electrophotographic imaging member, may be prepared and applied using conventional materials and methods. According to the present invention the charge generating layer can be provided by any conventional method including dip coating, roll coating, Meyer bar coating, bead coating, curtain flow coating and vacuum deposition so long as the charge generating layer is dried at ambient temperature. By ambient temperature is meant a temperature within 10° C. of the temperature of the environment in which the electrophotographic imaging member is formed. A preferred ambient temperature for drying the charge generating layer according to the process of the present invention is in the range of 5° C. to 40° C. more preferably the temperature is in the range of 15° C. to 35° C. and most preferably the temperature is in the range of 20° C. to 30° C. Ambient drying according to the present invention, is drying at ambient temperature for no more than 30 minutes prior to application of a subsequent layer of the electrophotographic imaging member. Preferably ambient drying is drying at the ambient temperature as defined herein for a period of no more than twenty minutes and most preferably at least a period of time to no more than two minutes.

A preferred method for applying the charge generating layer is by a rotary atomizer as disclosed in U.S. Pat. No. 5,037,676 to Petropoulos et al., U.S. Pat. No. 5,079,854 to Hammond et al., U.S. Pat. No. 5,219,690 to Hammond and U.S. Pat. No. 5,248,529 to Hammond et al. The disclosures of these patents are incorporated herein by reference.

The rotary atomizer process forms a coating by applying a layer to a substrate by means of a rotary atomizer. The process can be utilized for preparing an electrophotographic imaging member according to the present invention by a) delivering a fluid stream to the bell of a rotary atomizer wherein the stream comprises a charge generator material; b) atomizing the stream into a substantially atomized spray; c) depositing the substantially atomized spray onto a substrate in the form of a layer; and d) drying the layer at ambient temperature.

The process can comprise coating substrates with a charge blocking layer and individually affixing the substrates to a set of rotatable shafts to form a circular array. Coating and drying sequences can be executed by computer control devices and in accordance with algorithms well known in the art. The array of substrates can be moved by a transporting mechanism into an enclosed cylindrical coating chamber so that the axes of rotation of the substrates and the central axis of the coating chamber are parallel and horizontal. The central axis of the coating chamber is equidistant from the axes of rotation of the cylindrical substrates. Rotation of each substrate about its axis in the circular array is effected by electromechanical means. A flow of molecular nitrogen or other suitable inert gas is introduced into the coating chamber. The gas dilutes and displaces ambient air out of the chamber through exhaust porting. Flow of nitrogen gas through the chamber is maintained until the percentage of oxygen is less than 5% by volume.

Suitable rotary atomizers include Model RA-12 Rotary Atomizer of the Nordsom Corporation of Amherst, Ohio and rotary atomizers from the Devilbiss Ransburg Division of ITW Corporation of Chicago, Ill. or from Graco Corporation of Minneapolis, Minn. The rotary atomizer is located in a recessed cavity at the end of the coating chamber opposite the substrates. The atomizer is mounted on a mechanism which can move the rotary atomizer horizontally into the coating chamber along a trajectory such that the central axis of the atomizer is colinear with the central axis of the coating chamber. Rotation of the atomizing bell of the rotary atomizer initiates the coating sequence. The rotational speed of the atomizing bell can be accelerated to an angular velocity of 20,000 RPM and then maintained at this velocity.

The rotary atomizer is moved out of the recessed cavity at the end of the coating chamber to a position where the leading edge of the bell is coplanar with the substrate ends. Electrostatic power is activated and a high voltage potential is applied to the bell. At the same time, coating fluid is pumped through the bell to supply a flow of charge generator coating fluid. The coating fluid is sprayed from the edge of the spinning bell. Sprayed droplets follow a substantially radial trajectory outward to the circular substrate array. As the atomized droplets are formed at the edge of the bell, they are electrically charged by the electrostatic power supply. The sprayed, charged droplets are preferentially attracted to the circular array of substrates, which are maintained at ground potential.

Charge generating fluid is atomized and sprayed outwardly to the circular substrate array as the atomizer is moved horizontally along the central axis of the coating chamber. The rotating substrates are coated with a liquid layer of charge generating coating fluid at a uniform thickness. The substrates are completely coated with charge generator fluid when the atomizer has completely traversed along the substrate length.

The rotary atomizer process can be utilized to form a coating by separately delivering at least two substances in at least two fluid streams to the bell of the rotary atomizer. The fluid streams are combined substantially at the bell of the rotary atomizer such that the bell atomizes and mixes the fluid streams into a substantially homogeneous atomized mixture. The substantially homogenized atomized mixture is deposited onto a substrate in the form of a layer. Preferably, at least one of the plurality of fluid streams is a stream of a liquid dispersion of photoconductive particles. The layer on the substrate is solidified by ambient drying. The resulting coated substrate has a smooth layer with the plurality of substances homogeneously mixed therein. Suitable charge generator material can be delivered in any one of the fluid streams. The fluid stream can comprise a combination of charge generating material and charge transport material to form an interphase layer.

The charge generating material can include inorganic or organic photoconductive materials. The charge generating material for use in the present invention preferably includes compositions comprising a photogenerating pigment. More preferably, the photogenerating pigment is dispersed in a film-forming binder and the resulting dispersion is dissolved in a solvent for application of the charge generating layer.

Examples of photogenerating pigments include, but are not limited to, inorganic photoconductive particles such as amorphous silicon, selenium, trigonal selenium, selenium alloys, phthalocyanine pigment, metal phthalocyanines, metal-free phthalocyanines, dibromoanthanthrones, squarylium, quinacridones, benzimidazole perylene, substituted diamino triazines, polynuclear aromatic quinones and the like. If desired, other suitable, known photogenerating materials may be utilized.

Preferred selenium alloys include, but are not limited to, selenium-tellurium, selenium-tellurium-arsenic and selenium arsenide; preferred metal phthalocyanines include, but are not limited to, vanadyl phthalocyanine, titanyl phthalocyanine and hydroxygallium phthalocyanine; preferred dibromoanthanthrones include, but are not limited to, products available from dupont under the tradenames Monastral Red, Monastral Violet and Monastral Red Y, Vat orange 1 and Vat orange 3. Preferred polynuclear aromatic quinones include, but are not limited to, products available from Allied Chemical Corporation under the tradenames Indofast Double Scarlet, Indofast Violet Lake B, Indofast Brilliant Scarlet and Indofast Orange.

Charge generating layers comprising a photoconductive material such as amorphous silicon, vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof, are preferred because of their sensitivity to visible light. Vanadyl phthalocyanine, metal free phthalocyanine and selenium alloys are preferred because these materials are also sensitive to infrared light.

Any suitable polymeric film-forming binder material may be employed as a matrix in the charge generating layer. The binder polymer preferably 1) adheres well to the substrate or other underlying layer; and 2) dissolves in a solvent. Examples of materials useful as the film-forming binder include, but are not limited to, polyvinylcarbazole, phenoxy resin, polycarbonate, polyvinylbutyral, polystyrene, polystyrenebutadiene (polyvinyl chloride-polyvinyl acetate-maleic acid) and polyester.

Solvents used for the charge generating compositions of the invention should dissolve the film-forming binder of the charge generating layer and be capable of dispersing the photogenerating pigment particles present in the charge generating composition. Examples of typical solvents include, but are not limited to, monochlorobenzene, tetrahydrofuran, cyclohexanone, methylene chloride, 1,1,1-trichloroethane, 1,1,2trichloroethane, dichloroethylene, 1,2-dichloroethane, toluene, and the like, and mixtures thereof. Mixtures of solvents may be utilized to control evaporation rate. For example, satisfactory results may be achieved with a tetrahydrofuran to toluene ratio of between about 90:10 and about 10:90 by weight.

Preferably, the combination of photogenerating pigment, binder polymer and solvent should form uniform dispersions of the photogenerating pigment in the charge generating composition. Examples of charge generating layer compositions include, but are not limited to, benzimidazole perylene, polycarbonate and methylene chloride; polyvinylbutyral, titanyl phthalocyanine and tetrahydrofuran; phenoxy resin, copper phthalocyanine and toluene; and polyvinyl butyral resin, vanadyl phthalocyanine and n-butyl acetate.

Generally from about 5 percent by volume to about 95 percent by volume of the photogenerating pigment is dispersed in no more than about 95 percent by volume of the film-forming binder. In one embodiment, a volume ratio of the photogenerating pigment and film-forming binder is about 1:12, corresponding to about 8 percent by volume of the photogenerating pigment dispersed in about 92 percent by volume of the film-forming binder. In another embodiment, the volume ratio of the film-forming binder and photogenerating pigment is about 1:9 corresponding to about 90 percent of the photogenerating pigment dispersed in about 10 percent binder.

Exemplary charge generating layer thicknesses according to the present invention include, but are not limited to, thicknesses ranging from about 0.1 micrometer to about 5.0 micrometers, and preferably from about 0.9(0.2) micrometer to about 3 micrometers. Charge generating layer thickness generally depends on film-forming binder content. Higher binder content generally results in thicker layers for photogeneration. Thicknesses outside the above exemplary ranges are also within the scope of the invention.

The charge transport layer comprises any suitable organic polymer or non-polymeric material capable of transporting charge to selectively discharge surface charge. The charge transport layer is preferably transparent. It may not only serve to transport charges, but may also protect the imaging member from abrasion, chemical attack and similar destructive elements, thus extending the operating life of the electrophotographic imaging member. Alternatively, or in addition, a protective overcoat layer may provide these protective functions.

The charge transport layer should exhibit negligible, if any, discharge when exposed to a wavelength of light useful in xerography, e.g. 4000 Angstroms to 9000 Angstroms. Therefore, the charge transport layer is substantially transparent to radiation in a region in which the photoreceptor operates.

Charge transport materials for use in the present invention are preferably compositions comprising a hole transporting material dispersed in a resin binder and dissolved in a solvent for application.

Hole transporting materials for use in compositions according to the present invention include, but are not limited to, a mixture of one or more transporting aromatic amines. Exemplary aromatic amines include triaryl amines such as triphenyl amines, poly triaryl amines, bisarylamine ethers and bisalkylaryl amines.

Preferred bisarylamine ethers include, but are not limited to, bis(4-diethylamine-2-methylphenyl) phenylmethane and 4'-4"-bis(diethylamino)-2',2-dimethyl-triphenylmethane. Preferred bisaikylaryl amines include, but are not limited to, N,N'-bis(alkylphenyl)-(1,1'biphenyl)-4,4'-aliamine wherein the alkyl is, for example, methyl, ethyl, propyl, n-butyl, and the like. Meta-tolylbis-diphenylamino benzidine and N,N'-diphenyl-N,N'-bis(3"-methylphenyl)-(1,1'biphenyl)-4,4'-diamine are preferred transporting aromatic amines.

Exemplary resin binders used in charge transport compositions according to the present invention include, but are not limited to, polycarbonate, polyvinylcarbazole, polyester, polyarylate, polyacrylate, polyether and polysulfone. Molecular weights of the resin binders can vary from about 20,000 to about 1,500,000.

Preferred resin materials are polycarbonate resins having molecular weights from about 20,000 to about 120,000, more preferably from about 30,000 to about 100,000. Highly preferred resin materials are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; polycarbonate resin having a molecular weight of from about 50,000 to about 100,000, available as Makrolon from Farben Fabricken Bayer A. G.; polycarbonate resin having a molecular weight of from about 20,000 to about 50,000 available as Merlon from Mobay Chemical Company; polyether carbonates; and 4,4'-cyclohexylidene diphenyl polycarbonate.

Solvents useful to form charge transport layers according to the present invention include, but are not limited to, monochlorobenzene, tetrahydrofuran, cyclohexanone, methylene chloride, 1,1,1-trichloroethane, 1,1,2-trichloroethane, dichloroethylene, toluene, and the like. Methylene chloride is a desirable component of the charge transport layer coating mixture for adequate dissolving of all the components and for its low boiling point.

An especially preferred charge transport layer material for multilayer photoconductors comprises from about 25 percent to about 75 percent by weight of at least one charge transporting aromatic amine and about 75 percent to about 25 percent by weight of a polymeric film-forming resin in which the aromatic amine is soluble.

In one process of the invention, a charge generating layer is applied to form an underlying layer; the underlying layer is overcoated, prior to complete drying, with a charge transport material to form a charge transport layer; the charge transport material is allowed to diffuse into the undried underlying layer; and the underlying layer and charge transport layer are completely dried or cured to fix an interphase region having a mixture of a charge generating material and a charge transport material. Another exemplary process according to the invention permits control of the concentration of the charge generating material and charge transport material in the interphase region. The process includes simultaneously applying the charge generating material and charge transport material and decreasing the amount of the charge generating material while increasing an amount of the charge transport material. The mixture of layers comprises an interphase region that is dried at ambient temperature.

The invention will further be illustrated in the following examples, it being understood that these examples are illustrative only and that the invention is not limited to the materials, conditions, process parameters and the like recited therein.

EXAMPLES

Example 1 and Example 2

A 2% solution of Elvamide (polyamide from dupont) is sprayed on an aluminum drum substrate to a thickness of 0.5 micrometers and dried to form a blocking layer prior to applying a charge generating layer.

A. Charge Generating Layer

A vanadyl phthalocyanine/polyester charge generating layer is prepared according to the following procedure. 22.5 grams of polyester 100 (from dupont) is added to a mixture of 275 ml methylene chloride and 195 ml of 1,2-dichloroethane in a one liter container. The resulting mixture is placed on a roller mill for 90 minutes to mix thoroughly. 9.65 grams of vanadyl phthalocyanine are added to 160 ml of the above polyester/solvent mixture as are 150 grams of ⅛ inch stainless steelshot in an 8 oz. glass jar. The mixture in the glass iar is placed on a paint shaker to run at alternate 15 minute periods for 3 hours. After the three hour period, the glass jar contents are poured into a one liter bottle and placed on a roller mill for 60 minutes. At the end of this period, the contents of the bottle are strained into a two liter bottle. The one liter bottle and stainless steel shot are rinsed with the remaining polyester solvent mixture and then with an additional 867 ml of methylene chloride and 600 ml of 1,2-dichlorethane, which have been thoroughly mixed. The collected rinse is added to the 2 liter bottle, which is then placed on a roller mill for 60 minutes to thoroughly mix and obtain a final solution of 1.3% solids by weight. The final solution is spray coated to 1μ thickness on the previously prepared and dried polyamide layer according to the following procedure.

An array of substrates each coated with a charge blocking layer according to the procedure described above, is fixed to a set of rotatable shafts. The array of substrates is transported into an enclosed cylindrical coating chamber 5 feet in length and 3.5 feet in diameter (Model RA-12 Rotary Atomizer, Nordsom Corporation of Amherst, Ohio). A flow of molecular nitrogen is introduced into the chamber and is maintained until percentage of oxygen in the chamber is less than 5% by volume. The coating sequence is initiated by starting the rotation of the atomizing bell of the rotary atomizer. The rotational speed of the bell is accelerated to an angular velocity of 20,000 RPM and then is maintained at this velocity. An electrostatic power supply is activated and a high voltage potential is applied to the bell. At the same time, the coating fluid pumping means is activated to supply a flow of charge generator coating fluid to the bell. The process parameters in these Examples are as follows:

| | |
|---|---|
| Nitrogen Gas Flow Rate | 3,000 liters/min. |
| Substrate angular velocity during coating | 60 revolutions/min. |
| Atomizer bell angular velocity | 20,000 revolutions/min. |
| Electrostatic charging voltage | 120 kilovolts |
| Atomizer traversal velocity | 1.85 mm/sec |
| Coating fluid flow rate | 50 ml/min. |

The freshly sprayed charge generating layer is allowed to set at ambient temperature for 10 minutes.

B. Charge Transport Layer

A charge transport layer comprising a mixture of meta-toyl-bis-diphenylamino benzidine dispersed in a polycarbonate binder is prepared according to the following procedure. 1,854 ml of methylene chloride and 1,145 ml of 1,1,2-trichloroethane are combined in a one gallon amber jug (IUPILON Z-200, manufactured by Mitsubishi Gas Chemical Company, Inc.). 129.2 grams of polycarbonate are weighed on a single pan balance and added to the mixture in the amber jug. A screw cap is securely fastened on the jug, and the solution is mixed thoroughly and kept covered. To ensure complete mixing of the solution in the jug, the jug is placed on a roller mill for 90 minutes. The jug is removed from the roller mill and stored in a hood for 48 hours. 69.8 grams of meta-tolyl-bis-diphenylamino benzidine are weighed and added to the mixture in the jug. The screw cap is again securely fastened on the jug, the contents manually mixed and then again placed on a roller mill for 60 minutes resulting in a charge transport coating solution of 4.77% solids by weight. The resulting charge transport layer coating solution is sprayed onto the undried charge generating layer to obtain a 20μ thick layer. The charge transport layer coating solution is applied according to the same sequence of steps described above for the charge generator layer with the following process parameters:

| | |
|---|---|
| Nitrogen Gas Flow Rate | 3,000 liters/min. |
| Substrate angular velocity during coating | 60 revolutions/min. |
| Atomizer bell angular velocity | 20,000 revolutions/min. |
| Electrostatic charging voltage | 120 kilovolts |
| Atomizer traversal velocity | 0.7 mm/sec |
| Coating fluid flow rate | 100 ml/min. |

The resulting charge transport layer is allowed to dry.

The results of tests conducted on the imaging member are represented in column 1 of Table I. The following parameters were used in evaluating the characteristics of examples and comparative examples discussed in this specification:

$V_0$:

$V_0$ is the initial charge acceptance measurement. Voltage is observed 0.22 seconds after a charge of 100 nC/cm$^2$.

% DD:

The dark decay is expressed as a percentage of a voltage loss without exposure (in the dark) between 0.22 and 0.57 seconds after charging.

% Discharge

Photosensitivity is expressed as a percentage of voltage discharged by exposure to a fixed amount of light energy at a particular wavelength.

$V_{Contrast}$:

The voltage corresponding to percent discharge at a noted wavelength and exposure.

$V_e$:

The voltage remaining after exposure to approximately 300 ergs/cm$^2$ of a broad band (tungsten source) light.

Two examples were prepared according to the procedure described and were dried at ambient temperature for ten minutes. The evaluations of these examples are reported in the columns headed AMBIENT DRY. Two comparative examples were prepared according to the procedure described except that in each comparative example the charge generating layer was completely dried by forced air heating prior to application of the charge transport layer. The results of the comparative examples with forced air drying of the charge generator layer are reported in the columns headed DRY.

TABLE I

| | VANADYL 3 n = 2 | | VANADYL 4 n = 6 | |
|---|---|---|---|---|
| TRIAL | AMBIENT DRY | DRY | AMBIENT DRY | DRY |
| Vo | 927 | 982 | 876 | 926 |
| % DD (.35 sec.) | 2.3 | 1.1 | 2.1 | 1.0 |
| % DISCHARGE* | 66 | 40 | 62 | 39 |
| $V_{contrast}$** | 593 | 380 | 522 | 351 |
| $V_e$ | 26 | 30 | 25 | 35 |

*4.9 erg/cm$^2$, at 800 nm light.

**Measured at the same light energy and wavelength used to measure % Discharge.

The rotary atomization process with ambient drying of a charge generating layer that comprises vanadyl phthalocyanine pigment in a polyester PE 100 binder results in improved sensitivity of the final device at 800 nanometers compared to devices in which the charge generator layer has been dried at elevated temperatures. The compared devices have the same charge generating layer thickness and pigment loading and pigment batch and the same charge transport layer thickness and composition. The improvement in sensitivity is due to the difference in processing, i.e., the drying conditions for the charge generating layer. The electrical properties that are shown in Table I show significant improvement and sensitivity when the charge generating layer is dried at ambient temperatures compared to identical devices that are dried at elevated temperatures. The configuration for all devices was as follows: undercoat layer –5 microns of nylon; charge generator layer-polycarbonate binder and polycarbonate PC(Z). The trials labeled VANADYL 3 and VANADYL 4 show substantial difference in sensitivity.

Example 3

A solution of methoxymethylated nylon (tradename Luckamide 5003, Dainippon Ink & Chemicals Corp.) is prepared by dissolving 10 grams in a mixture of methanol/butanol/water (55/36/9 weight ratio) and heating until a clear solution is obtained. A thin layer of 1.5 micrometers is applied to the outer surface of a 30 mm Al pipe by immersing the pipe in the solution and slowly withdrawing the pipe at a rate of 340 mm/min. The resultant layer is held at ambient temperature and allowed to air dry for 40 minutes.

A charge generating layer dispersion is prepared by dissolving 27 grams of polyvinylbutyral (trade name Butvar, B-76, Monsanto Chemical Corp.) in 1500 grams of cyclohexanone. To this solution is added 48 grams of hydroxygallium phthalocyanine and 9583 grams of ⅛ inch stainless steel shot in a 4 liter bottle. The mixture is rolled on a roll mill for 6 days at a roll speed of 220 rpm. After removal of the shot by filtration and rinsing, the solids content of the dispersion is adjusted to 3.5 wt % solids with cyclohexanone. A charge generating layer is applied over the ambient dried undercoat by dip coating at a pull rate of 200 mm/min. This layer is allowed to dry at ambient conditions for twenty minutes.

Finally, a charge transport layer is applied by dip coating the above layers into a solution of m-tbd/polycarbonate in monochloro benzene to give a thickness of about 12 micrometers. The charge transport layer solution is a 35 wt % mixture of m-tolyl-bis-diphenylamino benzidine and 65 Wt % polycarbonate(IUPILON Z-200, Mitsubishi Gas Chemical Co. Inc.) in monochlorobenzene. The fully coated device is dried at 160° C. for twenty minutes. Three drums are prepared in an identical manner and the electrical properties are shown in Table II.

Comparative drums are prepared with drying of layers. The procedure outlined above is duplicated for each layer but the individual layers are dried in an oven between applications of subsequent layers. Drying conditions for the undercoat layer are 145° C. for 10 minutes. The charge generator layer is dried for ten minutes at 16° C.

Three drums are prepared in this manner and tested at the same time as the drums from Example 3. Results are shown in Table II.

Testing of these drums is done in an electrical scanner and the following properties are measured.

$V_o$—Initial Voltage $V_{3erg}$—voltage after an exposure of 3 ergs/sq-cm at 780 nm.

$V_{7erg}$—voltage after an exposure of 7 ergs/sq-cm at 780 nm.

$V_{25erg}$—voltage after exposure of 25 erg/sq-cm at 780 nm.

$V_{erase}$—voltage after exposure of about 300 ergs/sq-cm.

DV/DX—Initial slope of the discharge curve

TABLE II

| | Example 3 No dry (n = 3) | | Comparative Example 3 Dry all layers (n = 3) | |
|---|---|---|---|---|
| $V_o$ | 299 | 0.4 | 303 | 1.7 |
| $V_{3ergs}$ | 51 | 1.1 | 67 | 1.4 |
| $V_{7ergs}$ | 40 | 1.1 | 47 | 1.4 |
| $V_{25ergs}$ | 32 | 1.0 | 33 | 0.9 |
| $V_{erase}$ | 25 | 0.7 | 18 | 0.4 |
| DV/Dx | 220 | 2.8 | 188 | 1.6 |

These results show the improved sensitivity of the drums with the ambient dried layers compared to the devices made with all layers dried.

Example 4

The procedure of Example 3 is repeated with the exception that the substrate is 40 mm Al drums and the following changes are made in formulation:

Charge Generating Layer

A dispersion is prepared by dissolving 10 grams of vinyl chloride-vinyl acetate-maleic acid terpolymer (tradename VMCH, Union Carbide Corp.) in 180 grams n-butyl acetate and adding 10 grams hydroxy gallium phthalocyanine and 1080 grams of ⅛ stainless steel shot. The dispersion is roll milled for six days at a roller speed of 210 rpm. The shot is filtered and rinsed and the solids content of the dispersion is adjusted to a solids content of 4% by dilution with butyl acetate. The charge generating layer is applied by dip coating in a manner similar to Example 4.

Charge Transport Layer

The charge transport layer is the same as used in Example 3 but is applied to a thickness of 17 microns. Only a single drum is prepared in this manner with ambient drying of the undercoat layer and charge generating layer and oven drying after charge transport layer application at 160° C.

The procedure of this Example is repeated except the undercoat layer and charge generating layers are completely dried after application. Only one device was prepared. Electrical properties are measured in a scanner with exposure to 780 nm light and results are given in Table III.

TABLE III

| | Ambient dry of UCL/CGL* | All layers dried |
|---|---|---|
| $V_o$ | 389 | 394 |
| $V_{3ergs}$ | 89 | 104 |
| $V_{7ergs}$ | 53 | 62 |
| $V_{25ergs}$ | 40 | 45 |
| $V_{erase}$ | 18 | 20 |
| DV/Dx | 185 | 172 |

*Undercoat layer/charge generator layer.

These results show improved sensitivity for ambient dried devices over oven dried devices at 160°.

While the invention has been described with reference to particular preferred embodiments, the invention is not limited to the specific examples given, and other embodiments and modifications can be made by those skilled in the art without departing from the spirit and scope of the invention and the claims.

What is claimed is:

1. A process for preparing an electrophotographic imaging member having a charge generating layer and a charge transport layer, said process comprising:

applying a charge generating layer to an underlying layer and drying said charge generating layer at ambient temperature; and applying a charge transport layer to said charge generating layer prior to drying said charge transport layer.

2. The process according to claim 1, wherein said charge generator material is dissolved in a solvent.

3. The process according to claim 2, wherein the solvent is selected from the group consisting of monochlorobenzene, tetrahydrofuran, cyclohexanone, methylenechloride, 1,1,1-trichloroethane, 1,1,2trichloroethane, dichloroethyene, dichloroethane, toluene and mixtures thereof.

4. The process according to claim 3, wherein the charge generating material comprises a film forming binder and a photogenerating pigment and the film forming binder, photogenerating pigment and solvent are selected from the group of combinations consisting of polyvinylbutyral, titanyl phthalocyanine and tetrahydrofuran; phenoxy resin, copper phthalocyanine and toluene; and polyester resin, vanadyl phthalocyanine and a mixture of methylene chloride and 1,2-dichloroethane.

5. The process according to claim 1, wherein the charge generating layer is formed by applying said layer by spray coating, dip coating, roll coating, Meyer bar coating, bead coating or curtain flow coating.

6. A photoreceptor made by a process according to claim 1.

* * * * *